United States Patent [19]
Keyes, IV et al.
[11] Patent Number: 4,470,019
[45] Date of Patent: Sep. 4, 1984

[54] RATE MULTIPLIER SQUARE ROOT EXTRACTOR WITH INCREASED ACCURACY FOR TRANSMITTER APPLICATIONS

[75] Inventors: Marion A. Keyes, IV, Chagrin Falls; William L. Thompson, Chardon, both of Ohio

[73] Assignee: The Babcock & Wilcox Company, New Orleans, La.

[21] Appl. No.: 395,429

[22] Filed: Jul. 6, 1982

[51] Int. Cl.[3] ..... G06G 7/20; G06G 7/12
[52] U.S. Cl. ..... 328/144; 328/143; 364/752
[58] Field of Search ..... 328/142, 144, 145, 143; 307/529; 364/752, 814

[56] References Cited

U.S. PATENT DOCUMENTS

| | | | |
|---|---|---|---|
| 3,280,314 | 10/1966 | Weigler | 364/752 |
| 3,728,535 | 4/1973 | Dickman et al. | 364/814 |
| 4,088,960 | 5/1978 | Osborne | 364/814 |
| 4,346,346 | 8/1982 | Silberberg | 328/144 |

*Primary Examiner*—John S. Heyman
*Assistant Examiner*—Timothy P. Callahan
*Attorney, Agent, or Firm*—Vytas R. Matas; Robert J. Edwards

[57] ABSTRACT

Circuitry for extracting the square root of an incoming voltage signal is disclosed. The circuit (10) utilizes a four-bit up/down counter (14) to control the output duty cycle of a pair of four-bit rate multipliers (16, 18) connected in a cascaded configuration. The output of the second rate multiplier (18), which is related to the square of the up/down counter value, is used to control the mode of the counter (14) so as to track the incoming voltage signal. Inasmuch as the square of the up/down counter value is tracking the incoming voltage signal, the output duty cycle of the first rate multiplier (16) in the cascaded pair is the square root of the incoming voltage signal which is subsequently converted into analog form. The circuit also utilizes a "dithering" technique so that the resulting square root output signal has greater than four-bit accuracy.

6 Claims, 3 Drawing Figures

10
VOLTAGE COMPARATOR
28
CIRCUIT INPUT
12
CLOCK GENERATOR
C1 C2 C3
ST STROBE 4 BIT RATE MULTIPLIER OUT
CLK CLOCK A B C D
16
ST STROBE 4 BIT RATE MULTIPLIER OUT
CLK CLOCK A B C D
18
14
CLK QA QB QC QD 4 BIT UP/DOWN COUNTER
DN UP
ENABLE
30
ENABLE
24
RAMP SHAPER
LOW PASS FILTER
20
LOW PASS FILTER
22
CIRCUIT OUTPUT
26
W
SUMM-ATION CIRCUIT

RATE MULTIPLIER SQUARE ROOT EXTRACTOR WITH INCREASED ACCURACY FOR TRANSMITTER APPLICATIONS

TECHNICAL FIELD

This invention generally relates to circuitry for extracting the square root of an incoming voltage signal, and more particularly to square root extracting circuitry that provides a level of accuracy greater than that of its components.

BACKGROUND ART

Arithmetic operations are frequently encountered in instrumentation applications and/or systems. Even though "software" techniques can be used for these operations, in many applications it is not economically feasible to utilize a stored-program computer system to accomplish same. Because of this and in view of the rapid progress of semiconductor technology, digital techniques and methods have become extremely important in instrumentation systems. Thus, "hardware" systems are now performing many special arithmetic operations.

With respect to "hardware", rate multipliers can be configured with other circuit components to perform addition, subtraction, multiplication and other arithmetic functions. A severe limitation of these circuits is that to obtain increased accuracy, a larger digital word size must be used. The foregoing results in a corresponding increase in the required circuitry and an increase in processing time since processing is done in a serial manner. In addition, in most instances, the "hardware" requires a digital input and output format which is not compatible with most instrumentation systems.

Because of the foregoing, it has become desirable to develop a square root extractor circuit which utilizes a relatively small word size and yet achieves a high degree of accuracy, and which is compatible with an analog input and output format.

SUMMARY OF THE INVENTION

The present invention solves the aforementioned problems associated with the prior art as well as other problems by providing a square root extractor circuit that provides a high degree of accuracy and yet utilizes a relatively small word size. The circuit utilizes a pair of four-bit rate multipliers connected in a cascaded configuration. A four-bit up/down counter is used to control the frequency (or equivalently the output duty cycle) of these rate multipliers. The duty cycle of the second rate multiplier in the cascaded configuration, which is related to the square of the number in the up/down counter, is converted to an analog signal by a first low pass filter and compared to the incoming signal by a voltage comparator. The output of the comparator is used to control the operation of the up/down counter. Inasmuch as the squared counter value is tracking the input voltage, the output duty cycle of the first rate multiplier in the cascaded configuration is related to the square root of the input signal which is subsequently converted to analog form by a second low pass filter.

Greater than four bit accuracy is achieved at the output of the circuit by the addition of a small ramp signal to the output of the first low pass filter before comparing same with the incoming signal. This ramp signal "dithers" this comparison between adjacent four bit LSB (least significant bit) levels and causes the up/-down counter to oscillate about the true level with a duty cycle proportional to the true value difference. This "dither" is smoothed by the second low pass filter resulting in a square root analog signal having an accuracy greater than four bits.

DESCRIPTION OF THE PREFERRED EMBODIMENT

Figure 1:
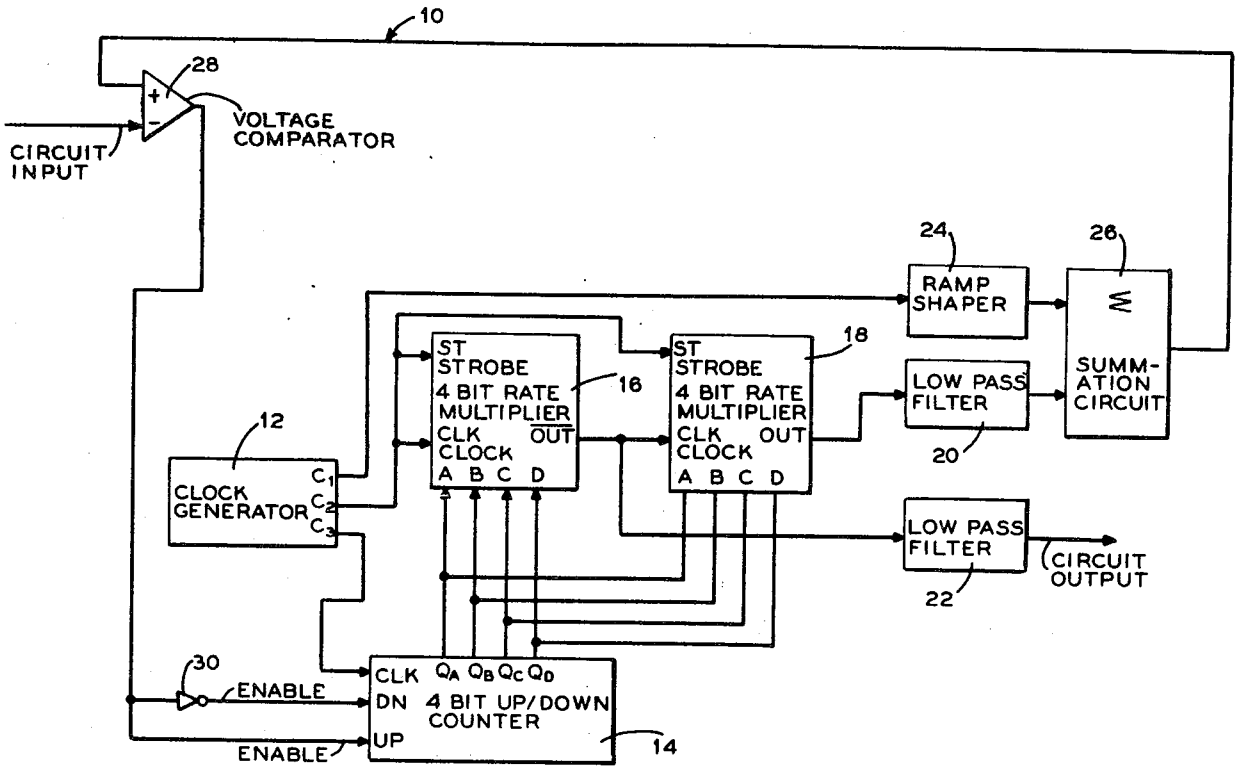
FIG. 1 is an electrical schematic of the invention of this disclosure.

Referring now to the drawings where the illustrations are for the purpose of describing the preferred embodiment of the present invention and are not intended to limit the invention hereto, FIG. 1 is a schematic diagram of the circuit 10 required to accomplish square root extraction. Circuit 10 is comprised of a clock generator 12, a four-bit up/down counter 14, four-bit rate multipliers 16 and 18, low pass filters 20 and 22, a ramp shaping circuit 24, a summation circuit 26, a voltage comparator 28, and an inverter 30.

As can be seen from FIG. 1, the outputs ($Q_A$ through $Q_D$) of thefour-bit up/down counter 14 are connected respectively to the inputs A through D to the four-bit multipliers 16 and 18. The $C_1$ output of the clock generator 12 is connected to the input to the ramp shaping circuit 24. The $C_2$ output of the clock generator 12 is connected to the clock (CLK) and the strobe (ST) inputs to the four-bit rate multiplier 16 and to the strobe (ST) input to the four-bit rate multiplier 18. The output of the four-bit rate multiplier 16 is connected to the clock (CLK)input to the four-bit rate multiplier 18 thus placing the rate multipliers 16, 18 in a cascaded configuration. The output of the multiplier 16 is also connected to the low pass filter 22 whose output is also the output of the circuit 10. The output of the four-bit rate multiplier 18 is connected to the low pass filter 20 whose output, along with the output of the ramp shaping circuit 24, is connected to the inputs to the summation circuit 26. The output of the summation circuit 26 is connected to the positive input to the voltage comparator 28 whereas the circuit input voltage signal is connected to the negative input thereof. The output of the voltage comparator 28 is connected to the UP input to the four-bit up/down counter 14 and is also connected to the input to an inverter 30 whose output is connected to the DOWN input to the counter 14. The $C_3$ output of the clock generator 12 is connected to the clock (CLK) input to this counter 14.

By connecting the four-bit rate multipliers 16 and 18 in a cascade configuration, the output duty cycle of the multiplier 18 is related to the square of the up/down counter 14 value, whereas the output duty cycle of the multiplier 16 is related to the counter 14 value. Thus, the counter 14 is used to control the output duty cycles of the rate multipliers 16, 18, and the output duty cycles of these multipliers 16, 18 are related to the value and the square, respectively, of the counter 14 value.

The detailed operation of the foregoing circuit is as follows. The clock generator 12 supplies a frequency $F_1$ to the four-bit rate muliplier 16. This frequency, $F_1$, is typically crystal controlled but may be from a stable oscillator of another type. The output of the four-bit rate multiplier 16 is the frequency $F_2$ which is related to the frequency $F_1$ by:

$$F_2 = \frac{nF_1}{16}$$

where n is a four-bit binary number outputted from the four-bit up/down counter 14. The output of the four-bit rate multiplier 18 is a frequency, $F_3$, given by:

$$F_3 = \frac{nF_2}{16}$$

Relating this to $F_1$ gives $$F_3 = \frac{n^2F_1}{256}$$

Figure 2:
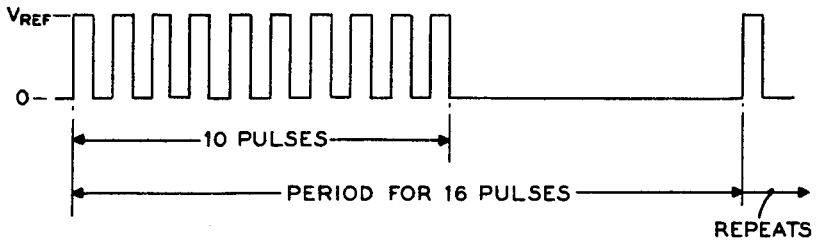
FIG. 2 illustrates the output waveform for the first four-bit rate multiplier in the cascaded configuration.

The low pass filters 20 and 22 convert the frequency signals to analog levels by integration. FIG. 2 illustrates a typical waveform for the output of the four-bit rate multiplier 16 shown with a value of n equals 10. The filtered or average value of this waveform will be one-half of the $V_{REF}$ voltage level when 16 pulses are present and proportionally smaller for n less than 16. The four-bit rate multiplier 18 will have up to 256 pulses at its output.

The low pass filter 20 provides the average voltage level from the four-bit rate multiplier 18. This level is dependent upon the reference voltage and on $n^2$ and is independent of the frequency $F_1$ of the clock generator 12. The low pass filter 22 extracts the average voltage level present in the waveform from the four-bit rate multiplier 16. The average value is proportional to the number of pulses present per group of 16 possible pulses. The output voltage, $E_o$, is then:

$$E_o = AF_2$$

where A is a constant of proportionality. Relating $E_o$ to $E_i$ (circuit input):

$$E_i = BF_3$$

$$E_i = \frac{Bn^2F_1}{256}$$

$$\sqrt{E_i} = n\sqrt{\frac{BF_1}{256}}$$

$$E_o = \frac{AnF_1}{16}$$

$$E_o = n\left(\frac{AF_1}{16}\right)$$

The only variable in the above expressions is the value of n. Therefore $$E_o = A_1\sqrt{E_i}$$

where $A_1$ is a constant of proportionality determined by the voltage amplitude of the output waveform of the four-bit rate multiplier 16 and the width of the individual pulses.

Considering the operation of the circuit 10 without the "dithering" technique, the output of the low pass filter 20 is compared with the input voltage signal by means of the voltage comparator 28. The output of the voltage comparator 28 is a digital (1) when the input voltage signal is greater than the output of the low pass filter 20, and is a digital (0)when the input voltage signal is less than the output of the low pass filter 20. This digital signal is used to control the direction of incrementing of the four-bit up/down counter 14. For example, assume that the output of the voltage comparator 28 is a digital (1), i.e., the input voltage signal is greater than the output of the low pass filter 20, then this digital (1)is applied to the UP input to the four-bit up/down counter 14, and, because of the inverter 30, a digital (0) is applied to the DOWN input thereof. The foregoing causes the four-bit up/down counter 14 to count up one binary digit when it receives a pulse from the clock generator 12, i.e., the value of n increases, which, in turn, causes an increase in the output frequencies and output voltages of the four-bit rate multipliers 16 and 18. Similarly, if the output of the voltage comparator 28 is a digital (0), i.e., the input voltage signal is less than the output of the low pass filter 20, then application of this digital (0) to the UP input to the four-bit up/down counter 14, and a digital (1) to the DOWN input thereof, causes the four-bit up/down counter 14 to count down one binary digit, when it receives a pulse from the clock generator 12, i.e., the value of n decreases. A reduction in the value of n causes a decrease in the output frequencies and output voltages of the four-bit rate multipliers 16 and 18. Under either condition, by closing the feedback loop comprised of the four-bit rate multiplier 18, the low pass filter 20 and the voltage comparator 28, the four-bit up/down counter 14 gives a determination of $n^2$ that tracks the input voltage signal.

Figure 3:
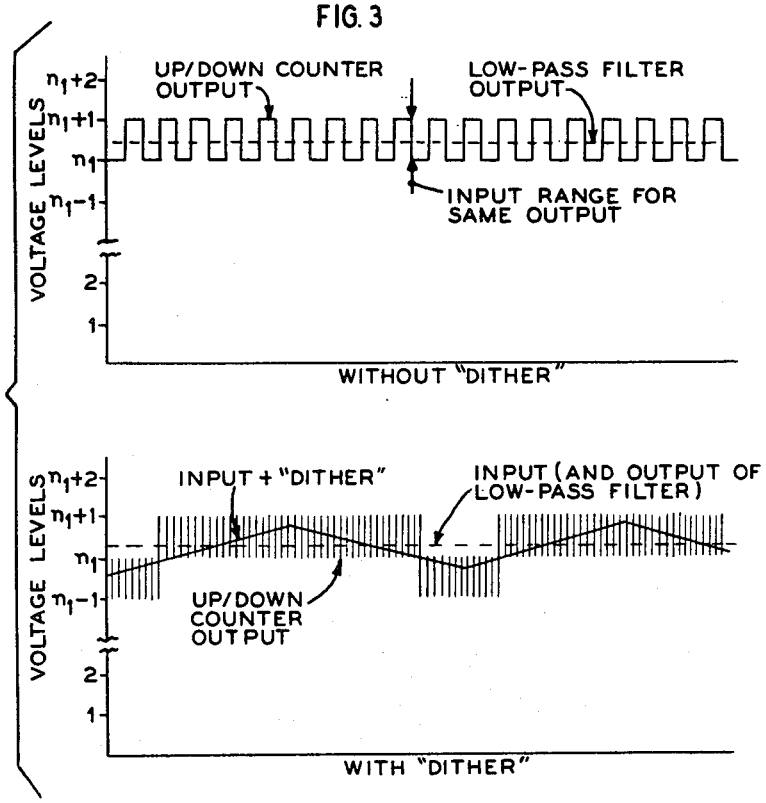
FIG. 3 illustrates the output waveform (without "dither" and with "dither") for the four-bit up/down counter and for the low pass filter connected to the output of the second four-bit rate multiplier in the cascaded configuration.

This feedback loop will, by its nature, alternate between successive values of n for a constant input voltage. Neither value will be exactly correct, one value will be too high while the other value will be too low, i.e., the circuit will constantly "hunt", as illustrated in FIG. 3(*a*). There is a range of values of input voltages that will fit in the distance between the two voltages determined by the two n values.

The "average" value of n as determined by the output of the low pass filter 20 will be half-way between the two alternating values. This can give an error of $\pm n/2$. If a "dither" or varying voltage of sufficient magnitude is added to or subtracted from the output of the low pass filter 20, the value of n will alternate between one pair of values for part of the period of the "dither" signal and between another two values either up or down by one unit of n for another part of the period of the "dither" signal. The fraction of time that it resides between each pair of values of n is determined by the relative value of the input voltage signal compared to the ideal value of the output of the low pass filter 20 for the two n values. FIG. 3*b* shows a representation of "n"

versus time compared to the output of the low pass filter 20.

The shape of the "dither" voltage with time determines the shape of the interpolation approximation between the integer values of n. The most elementary is a linear sawtooth voltage, giving a linear extrapolation between values of n. Other waveform shapes may be used to improve the accuracy of the interpolation estimation. The linear interpolation or extrapolation waveform is typically generated by integrating a square wave. The "dither" waveform must not contain a non-zero average value, otherwise, it would introduce an offset in the value of n calculated by the circuit. For this reason, the "dither" voltage produced by the ramp shaping circuit 24 is typically capacitor coupled to the summation circuit 26.

The amplitude of the "dither" voltage must be sufficient to add and subtract a value to span that determined by two adjacent values of n. Since the operation of this circuit 10 is non-linear, the adjacent values of n give voltage differences that change from large values of n to small values thereof. Constant amplitude "dither" will then span more than one pair of n values either way from the nominal set at the lower end of the scale. Circuitry can be provided to produce a "dither" voltage having an amplitude proportional to the input signal level, if desired.

From the foregoing, it is apparent that the use of the "dithering" technique by means of the ramp shaping circuit 24 results in greater than four-bit accuracy being achieved. The ramp signal "dithers" the comparison between adjacent four-bit LSB (least significant bit) levels and causes the four-bit up/down counter 14 to oscillate about the true (but unachievable with four bits) level with a duty cycle proportional to the true value differences. This "dither" is smoothed by the low pass filter 22 resulting in a square root output that is more accurate than four bits.

In summary, the primary significance of this "dithering" technique is to extend the resolution and accuracy of a digital circuit implementation of a calculation by an analog interpolation. This technique can more than double the number of bits of accuracy of a digitally implemented calculation.

Certain modifications and improvements will occur to those skilled in the art upon reading the foregoing. It should be understood that all such modifications and improvements have been deleted herein for the sake of conciseness and readability but are properly within the scope of the following claims.

We claim:

1. A circuit for extracting the square root of an incoming signal comprising a frequency generator producing a substantially constant frequency output, a first multiplying means connected to said frequency generator, a second multiplying means connected to said frequency generator and to the output of said first multiplying means, counter means connected to said first and second multiplying means to regulate the operation thereof, and means for comparing the output of said second multiplying means with the incoming signal, said comparing means producing an output signal in response to a difference between the output of said second multiplying means and the incoming signal, said output signal controlling the output of said counter means.

2. The circuit as defined in claim 1 wherein said first and second multiplying means are connected in a cascaded configuration causing the output of said second multiplying means to be related to the square of the output of said counter means and causing the output of said first multiplying means to be related to the output of said counter means and to the square root of the incoming signal.

3. The circuit as defined in claim 1 further including first filtering means connected to the output of said first multiplying means, said first filtering means producing the average waveform of the output of said first multiplying means, and first multiplying means average output waveform being related to the square root of the incoming signal.

4. The circuit as defined in claim 1 further including filtering means connected to the output of said second multiplying means, said second filtering means producing the average waveform of the output of said second multiplying means for comparison with the incoming signal by said comparing means.

5. The circuit as defined in claim 1 further including means for varying the output of said second multiplying means to stabilize the output of said counter means for a substantially constant incoming signal.

6. The circuit as defined in claim 5 wherein said varying means comprises a signal which is combined with the output of said second multiplying means prior to comparison thereof with the incoming signal.

* * * * *